US005689946A

United States Patent [19]

Schmid

[11] Patent Number: 5,689,946

[45] Date of Patent: Nov. 25, 1997

[54] OPENING ROLLER FOR AN OPEN-END SPINNING ARRANGEMENT

[75] Inventor: Friedbert Schmid, Bad Überkingen, Germany

[73] Assignee: Spindelfabrik Süssen, Schurr Stahlecker & Grill GmbH, Süssen, Germany

[21] Appl. No.: 693,016

[22] Filed: Aug. 6, 1996

[30] Foreign Application Priority Data

Aug. 26, 1995 [DE] Germany ..... 195 31 495.6

[51] Int. Cl.[6] ..... D01H 4/32

[52] U.S. Cl. ..... 57/408; 57/412; 19/233; 19/115 R

[58] Field of Search ..... 57/408, 112, 412; 19/233, 115 R

[56] References Cited

U.S. PATENT DOCUMENTS

| | | | |
|---|---|---|---|
| 4,196,496 | 4/1980 | Stauffer et al. | 19/97 |
| 4,300,265 | 11/1981 | Heinen | 57/408 X |
| 4,435,953 | 3/1984 | Schmid et al. | 57/408 |
| 4,679,390 | 7/1987 | Stewart | 57/408 |
| 4,715,177 | 12/1987 | Stahlecker | 57/408 |
| 4,805,395 | 2/1989 | Stahlecker et al. | 57/408 |
| 4,833,757 | 5/1989 | Stahlecker | 57/408 X |
| 4,894,983 | 1/1990 | Schmid | 57/408 |
| 4,939,897 | 7/1990 | Schmolke | 57/408 X |
| 5,085,047 | 2/1992 | Hofmann | 57/408 |
| 5,318,497 | 6/1994 | Aarnink et al. | 492/30 |
| 5,465,567 | 11/1995 | Schmolke et al. | 57/408 |

FOREIGN PATENT DOCUMENTS

| | | | |
|---|---|---|---|
| 0352460A1 | 1/1990 | European Pat. Off. . | |
| 3645275C2 | 11/1987 | Germany . | |
| 4039634 A | 6/1992 | Germany | 57/408 |
| 93002238 | 2/1993 | WIPO | 57/408 |

*Primary Examiner*—Daniel P. Stodola
*Assistant Examiner*—Tina R. Taylor
*Attorney, Agent, or Firm*—Evenson McKeown Edwards & Lenahan, PLL

[57] ABSTRACT

An opening roller for an open-end spinning arrangement is provided with a combing ring, which is slidably mounted onto a base body and is supported between two clamping surfaces. In order to fix the combing ring radially to a cylindrical guiding surface of the base body, the combing ring is provided with a centering surface on its inner circumferential surface. The combing ring has stopping surfaces on its end sides, which are arranged to engage the clamping surfaces. The centering surface is limited to an end area of the inner circumferential surface. The part of the inner circumferential surface of the combing ring which is located outside of this end area is free from counter-surfaces of the base body. As a result of this arrangement, the seat-engaging surfaces are on the one hand very short, while on the other hand various embodiments of combing rings can be used.

13 Claims, 2 Drawing Sheets

OPENING ROLLER FOR AN OPEN-END SPINNING ARRANGEMENT

BACKGROUND AND SUMMARY OF THE INVENTION

The present invention relates to an opening roller for an openend spinning arrangement comprising a combing ring slidably mounted onto a base body and supported between two clamping surfaces, which combing ring is provided on its inner circumferential surface with a centering surface, as well as with front end face stopping surfaces arranged to engage the clamping surfaces for the purpose of radially fixing the combing ring to a cylindrical guiding surface of the base member.

Opening rollers of this type are common today and described in a series of publications (German patent 36 45 275 C2, European published patent application 352 460 A1, U.S. Pat. No. 4,196,496, U.S. Pat. No. 4,300,265, U.S. Pat. No. 5,318,497). In the case of these known opening rollers, the centering surface extends over almost the entire inner circumferential surface of the combing ring, or the combing ring is guided by a plurality of cylindrical guiding surfaces of the base body or even by a plurality of parts. In all cases, the centering surfaces are very long, whereby in some cases there is the added disadvantage that with respect to the seat-engaging surfaces, there is a certain degree of redundancy.

In practice, various combing ring embodiments are used to suit various types of fiber material. On the one hand, the combing rings must be quickly replaceable, and on the other hand, cost effective to produce, that is, they must have the smallest possible working surface area.

It is an object of the present invention to meet these requirements and to produce an opening roller whose combing ring has, in adaptation to the base body, the smallest possible working surfaces and which can to a certain degree be varyingly constructed, in particular with relation to its wall thickness.

This object has been achieved in accordance with the present invention in that the centering surface is limited to an end area of the inner circumferential surface and that the part located outside this end area of the inner circumferential surface is free from any counter-surfaces arranged to the base body.

It has been demonstrated that the slidably mounted centering surface of the combing ring mounted on the cylindrical guiding surface of the base body can be very short when the combing ring is clamped at its front end stopping surfaces between opening roller clamping surfaces. Thus the functional part of the inner circumferential surface can be kept to a short length. As the inner circumferential surface is free from any counter-surfaces of the base body outside of the end area comprising the centering surface, the wall thickness of the combing ring can thus be increased inwards if so required. This is particularly purposeful when the combing means is a saw-tooth wire set into helix-shaped grooves of the combing ring.

The end area of the combing ring which comprises the centering surface is advantageously provided with a non-contact assembly securing device. This ensures that the combing ring can only be assembled in the correct position. The non-contact securing device can take the form, for example, of the one in German published patent 36 45 275 C2.

Alternatively, it is of course possible to apply the assembly securing device also to the end area of the combing ring facing away from the centering surface.

The opening roller according to the present invention can be fitted with combing rings whose combing means are made in one piece with the combing ring. This type of combing ring is hardened before grinding and is therefore made of steel. Combing rings made of steel such as these should be constructed with the smallest possible wall thickness, so that, after such a combing ring has been replaced, no renewed balancing of the opening roller is necessary. Apart from the end areas, in particular the above mentioned non-contact assembly securing device, the inner circumferential surface of a combing ring of this type is advantageously made with a constant inner diameter.

However, spinning mills also occasionally express the wish to use combing rings for certain types of fiber material which are made of a light metal alloy and onto which a saw tooth wire is wound. This type of combing ring is usually provided with helix-shaped grooves on its outer surface, which take up the saw tooth wire under tension. In the area of the helix-shaped wire combing means, the wall thickness of the combing ring should be strengthened, so that when the saw-tooth wire is wound on, no difficulties arise. This is made possible in that a large part of the inner circumferential surface of the combing ring is free from any counter-surfaces arranged at the base body. In the publications mentioned above in prior art, this is not the case.

A graduated diameter is provided especially in the case of combing rings around which a saw-tooth wire is wound, so that the combing ring has a smaller diameter outside of the centering surface than at the centering surface. This area of the combing ring is not hindered by the counter-surfaces of the base body.

Overall, in the case of all embodiments mentioned, the centering surface is shorter in axial direction than the part of the inner circumferential surface located outside thereof.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
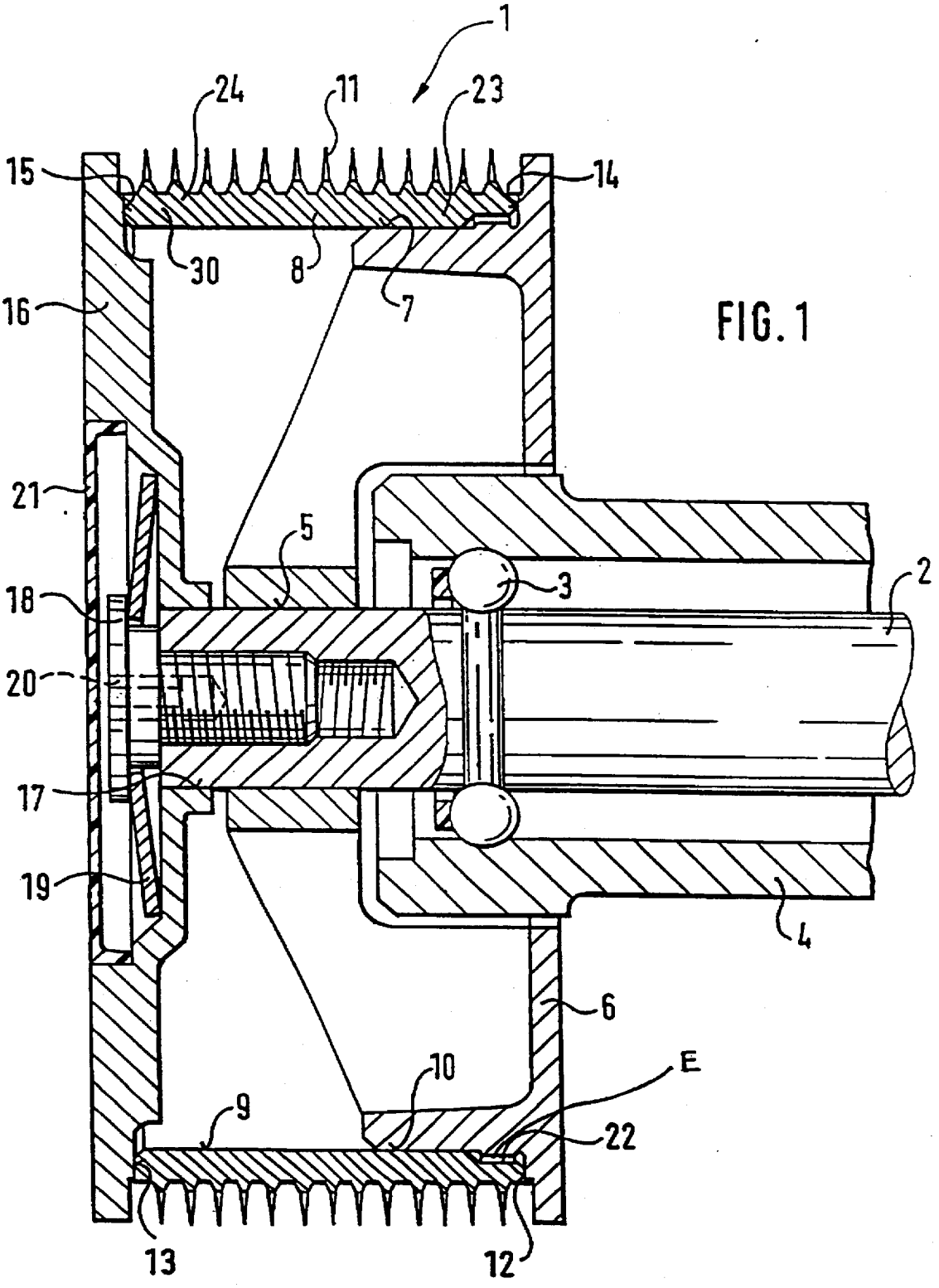
FIG. 1 is an axial section through the opening roller constructed according to the present invention, whose combing ring has a constant inner diameter.

The opening roller denoted with a 1 as shown in FIG. 1 is mounted on a shaft 2, which is supported in a bearing housing 4 by means of bearings 3. The end of the shaft 2 (not shown) projects outwards over the bearing housing 4 and is provided with a drive wharve for a drive belt (not shown).

A base body 6 of the opening roller 1 is slid onto the shaft 2 by means of a press fit 5. The base body 6 has a cylindrical guiding surface 7 in the area of its outer circumference, on which guiding surface 7 a combing ring 8 is slid with an easily detachable sliding fit. A centering surface 10 on the inner circumferential surface 9 of the combing ring 8 is thus arranged to slidably engage the cylindrical guiding surface 7.

The combing means 11 is ground out of a hardened ring of steel and thus made in one piece with the combing ring 8.

After the combing ring 8 has been slid onto the base body 6, it rests with a front stopping surface 12 against a base body flange which takes the form of a clamping surface 14. The opposite end face stopping surface 13 of the combing ring 8 is braced in relation to the clamping surface 14 of the base body 6 by means of a clamping surface 15 of a tension disc 16.

The tension disc 16 comprises a centrical bore hole 17, with which the tension disc 16 is slid onto the shaft 2 with a light sliding fit, the shaft 2 projecting outwards over the base body 6. The tension disc 16 is secured axially by a screw 18, which is screwed into a centrical thread bore hole of the shaft 2. The head of the screw 18 is supported by means of a disc spring 19 and is provided centrically with working surfaces 20 for a machine tool.

After assembly of the combing ring 8, the area of the screw 18 is covered by a plastic cap 21 which is slid into the tension disc 16, so that a smooth front surface is created for the tension disc 16. The cap 21 can be easily detached (not shown) from the tension disc 16 for the purpose of releasing the screw 18.

In order to ensure that the combing ring 8 is assembled in the correct position, the inner circumferential surface 9 of the combing ring 8 is provided with a circular groove-like recess on its front stopping surface 12. This recess is arranged at a collar-like elevation E of the base body 6, which elevation is somewhat shorter in axial direction than the recess and whose height is less than the radial depth of the recess. This results in a non-contact assembly securing device 22. This is important insofar as the tooth-like combing means 11 is asymmetrically shaped in circumferential direction.

In order that the seat-engaging surfaces, namely the cylindrical guiding surface 7 of the base body 6 and the centering surface 10 of the combing ring 8 are as short as possible, the centering surface 10, in accordance with the present invention, is restricted to an end area 23 of the inner circumferential surface 9. The part 24 of the inner circumferential surface 9 located outside this end area 23 is free from all counter-surfaces of the base body 6. This embodiment is possible as the end face stopping surfaces 12 and 13 of the combing ring 8 are supported between the clamping surface 14 and 15. A centering surface 10 which measures only a few millimeters is sufficient. The centering surface 10 is thus much shorter in axial direction of the combing ring 8 than the rest of the part 24 of the inner circumferential surface 9.

Apart from the above mentioned end area 23 and the other end area 30 of the combing ring 8, the inner circumferential surface 9 of the combing ring 8 in the embodiment according to FIG. 1 has a constant inner diameter. Despite this, it is not necessary to work the entire inner circumferential surface 9 with equally narrow tolerances throughout.

Figure 2:
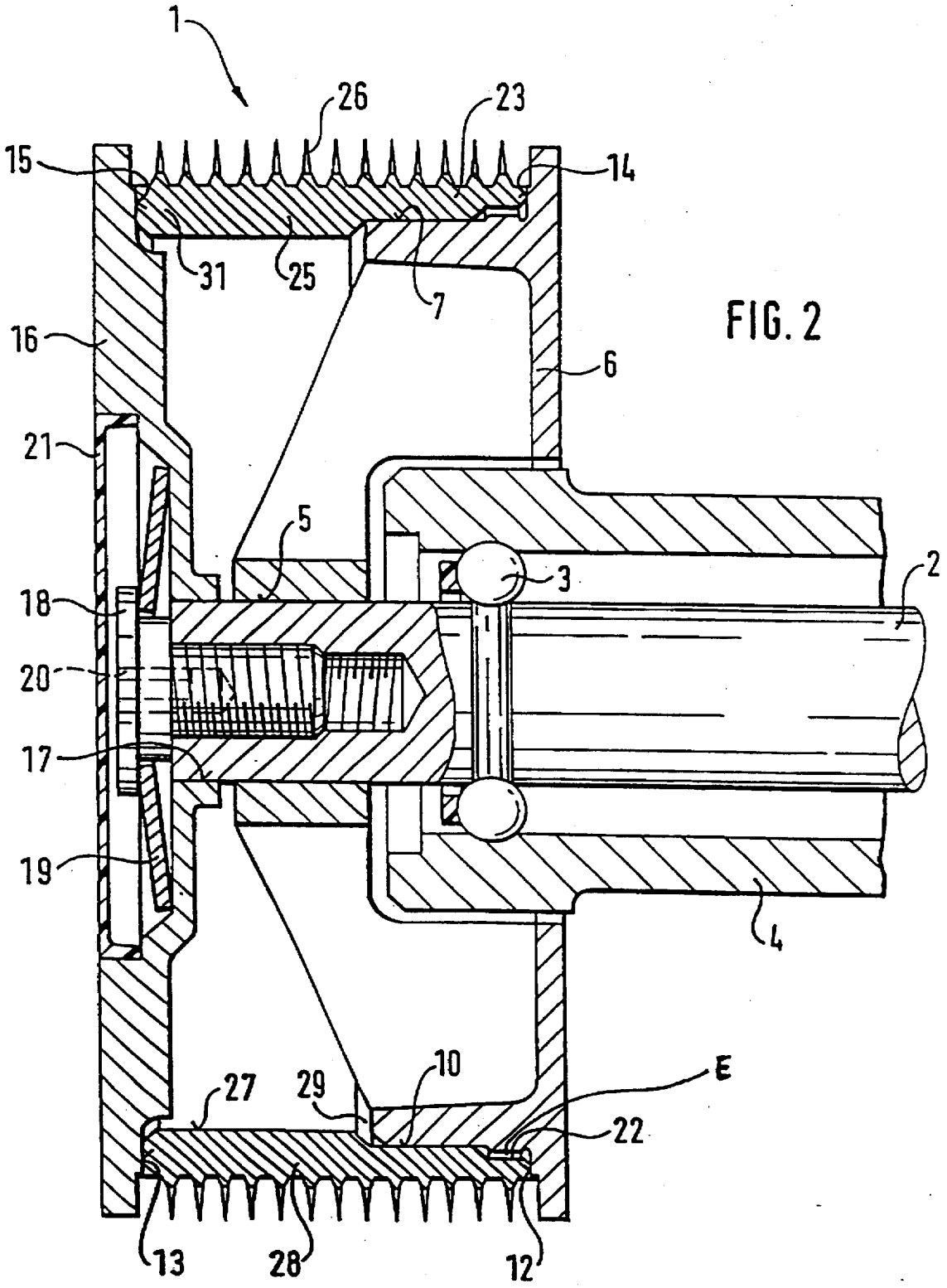
FIG. 2 is an opening roller similar to FIG. 1, whereby the combing ring has a graduated diameter on its inner circumferential surface.

In the embodiment according to FIG. 2, similar reference numbers are provided as those in FIG. 1, insofar as the respective embodiment is identical or has at least the same function. Therefore FIG. 2 will be not be described completely as the description of those common elements from FIG. 1 are described above in conjunction with FIG. 1.

The embodiment according to FIG. 2 differs from the embodiment in FIG. 1 essentially in that the opening roller 1 comprises a combing ring 25, which is made of a light metal alloy, for example an aluminum alloy. The combing ring 25 according to FIG. 2 is equipped with a saw-tooth wire 26, as is usual in many applications. In order that when the saw-tooth wire 26 is being applied to the light metal combing ring 25, no difficulties arise, in particular when helical-shaped grooves are being cut in for the saw-tooth wire 26, the wall thickness outside of the centering surface 10 is strengthened. Thus a graduated diameter 29 arises at the inner circumferential surface 27 in that part 28 outside of the end area 23, so that the inner circumferential surface 27 has two varying inner diameters. The light metal combing ring 25 is thus made sufficiently stable. This embodiment is useful when the same outer diameter is to be maintained for the saw-tooth wire 26 as in the case of the combing means 11 according to FIG. 1 and when the same base body 6 is applied.

As a result of the graduated diameter 29, the end face stopping surface 13 of the combing ring 25 is somewhat wider than the corresponding stopping surface 13 of the combing ring 8 according to FIG. 1.

In order that the wall thickness of the combing ring 25 can be strengthened in a large as possible part of its axial length, it is useful when the centering surface 10 is as short as possible. It is thus, as in the embodiment according to FIG. 1, limited to the end area 23 of the combing ring 25. Due to the absence of base body counter-surfaces, there is no difficulty in increasing the wall thickness of the combing ring 25 as required.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An opening roller for an open-end spinning arrangement comprising a combing ring with combing structure which can be slid onto a base body and which is supported between two clamping surfaces, which combing ring is provided with only one centering surface on its inner circumferential surface, for fixing the same radially on a cylindrical guiding surface of the base body, wherein the combing ring includes end face stopping surfaces arranged to engage the clamping surfaces, wherein the centering surface is limited to an axial end area of the inner circumferential surface and the part of the inner circumferential surface located outside of this end area is free from counter-surfaces of the base body, and wherein the centering surface is shorter in axial direction than the part of the inner circumferential surface located outside of the centering surface.

2. An opening roller according to claim 1, wherein the end area is provided with a non-contact assembly securing device.

3. An opening roller according to claim 2, wherein the combing ring is made of steel and is made in one piece with the combing means located on its outer circumference.

4. An opening roller according to claim 1, wherein the combing ring is made of steel and is made in one piece with the combing means located on its outer circumference.

5. An opening roller according to claim 4, wherein, apart from both end areas the inner circumferential surface of the combing ring has a constant inner diameter throughout.

6. An opening roller according to claim 1, wherein the combing ring is made of a light metal alloy and whereon a saw-tooth wire is wound.

7. An opening roller according to claim 6, wherein the inner circumferential surface has a smaller diameter outside of the centering surface than the centering surface itself.

8. A spinning machine opening roller assembly comprising:

a base body having only one radially outwardly facing centering guiding surface, a combing ring slidably mountable on said base body centering guiding surface, and a clamping member spaced from the base body and clampingly engageable with an end of said combing ring which is spaced from the centering guiding surface, whereby more than half of the axial length of the combing ring is unsupported along its inner circumference between the clamping member and the centering guiding surface.

9. An opening roller assembly according to claim 8, wherein, apart from both end areas the combing ring has a cylindrical inner surface of constant diameter along the length of the combing ring.

10. An opening roller assembly according to claim 8, wherein the combing ring has a stepped cylindrical inner surface with a first large internal diameter section engageable over the centering guiding surface and a second smaller internal diameter section over the remaining length of the combing ring.

11. A method of making a spinning machine opening roller assembly comprising:

providing a base body having only one radially outwardly facing centering guiding surface, providing a combing ring and slidably mounting said combing ring on said base body centering guiding surface, and clampingly engaging an end of the combing ring spaced from the base body with a clamping member which is spaced from the centering guiding surface, whereby more than half of the axial length of the combing ring is unsupported along its inner circumference between the clamping member and the centering guiding surface.

12. A method according to claim 11, wherein the combing ring has a stepped cylindrical inner surface with a first large internal diameter section engageable over the centering guiding surface and a second smaller internal diameter section over the remaining length of the combing ring.

13. A method according to claim 12, wherein tubular walls of said unsupported axial length of the combing ring are substantially thicker than the tubular walls forming the axial length of the combing ring supported by the base body centering guiding surface.

* * * * *